US006434874B1

(12) United States Patent
Hines

(10) Patent No.: US 6,434,874 B1
(45) Date of Patent: Aug. 20, 2002

(54) DIGIT SUPPORT

(76) Inventor: Stephen Charles Hines, P.O. Box 423, Edgewood, NM (US) 87059

( * ) Notice: Subject to any disclaimer, the term of this patent is extended or adjusted under 35 U.S.C. 154(b) by 0 days.

(21) Appl. No.: 09/736,882

(22) Filed: Dec. 14, 2000

Related U.S. Application Data

(60) Provisional application No. 60/170,750, filed on Dec. 14, 1999.

(51) Int. Cl.[7] ..... F41C 23/00
(52) U.S. Cl. ..... 42/74; 89/1.42; 42/72
(58) Field of Search ..... 42/74, 72; 89/1.42

(56) References Cited

U.S. PATENT DOCUMENTS 5,810,222 A * 9/1998 Shoemaker ..... 224/244
5,822,905 A * 10/1998 Teetzel ..... 42/103
6,070,352 A * 6/2000 Daigle ..... 42/49.02

OTHER PUBLICATIONS

Shotgun News, "Duckbill Tactical Grip", Nov. 20, 2000, p. 140.*
Advertisement, Shotgun News, Nov. 20, 2000, p. 140 V. 54, #33, Primedia Enthusiasts' Group, Peoria, IL.

* cited by examiner

*Primary Examiner*—Michael J. Carone
*Assistant Examiner*—Denise J Buckley
(74) *Attorney, Agent, or Firm*—Geoffrey E. Dobbin

(57) ABSTRACT

A digit support for AR family receivers designed to reside in a gap left between a receiver's pistol grip and trigger guard. The support fills the gap and ideally separates a user's digit from the gap, thereby protecting the user's digit from injury due to prolonged contact with the walls forming said gap. The digit support is easily installed without removal of any components of or attachments to the receiver and in its best mode allows for the simultaneous opening of the receiver's trigger guard. In the best mode, the support is a body molded from a rubber compound having dimensions to fit snugly in the gap left between the trigger guard and the pistol grip. Ideally, the remaining exposed surface extends slightly higher than the depth of the gap and is cylindrically domed. Also in the best mode, the side of the body abutting the trigger guard mount should have a concavity designed to fit around the trigger guard mount so as to encompass said mount.

15 Claims, 7 Drawing Sheets

DIGIT SUPPORT

CROSS-REFERENCES TO RELATED APPLICATIONS AND PATENTS

This application is a perfection of provisional application No. 60/170,750, filed on Dec. 14, 1999.

FIELD OF INVENTION

The invention related to a support for the fingers of the user of an AR15/M16 type rifle receiver and more particularly relates to a digit support used to fill a gap machined between the pistol grip mount and trigger guard of said receivers so that repetitive use of the rifle will not cause injury to a user's third finger.

BACKGROUND OF THE INVENTION

The concept of filling or covering the gap between the trigger guard's rear mounting point and the rifle's grip is known in the prior art. However, such efforts have been limited and are usually restricted to the use of gloves or projections fashioned on the grip that function to cover the gap. For example, the "duckbilled grip" by Alamo Sales in Huntsville, Ala., is illustrative of the prior art. The unpatented "duckbilled grip" features a projection extending outward from the upper forward side of the grip, immediately below the mounting base. This projection is rounded, gently sloped, and protrudes far enough forward to contact the trigger guard of the rifle's receiver. In so doing, the gap between the grip and trigger guard is covered. While suitable for its purpose, the "duckbilled grip" prohibits a user from opening the trigger guard on the rifle and requires replacement of the rifle's grip. The only other known methods of protecting a user's fingers from injury from the gap is the use of gloves or packing the gap with a foam earplug and covering the plug with tape.

While the aforementioned invention accomplishes its objective, it does not describe a device that fills the gap and uses the trigger guard as an anchor to keep it firmly in place. It also does not describe a device that will allow a user to open a receiver's trigger guard in the event a user needs to do so. In these respects, the digit support according to the present invention departs substantially from the usual designs in the prior art. In doing so, this invention provides a unique device capable of filling the gap between the trigger guard and grip in the trench machined in the receiver for the reception of said trigger guard while at the same time allowing the trigger guard to open and avoiding time consuming replacement of the rifle grip.

SUMMARY OF THE INVENTION

In view of the foregoing disadvantages inherent in the prior art, this invention provides an improved digit support. As such, the present invention's general purpose is to provide a new and improved implement that will cushion the fingers of the user of an AR15/M16 family rifle by filling the gap between the grip of the rifle and the trigger guard of the rifle's receiver.

To attain this, the digit support essentially comprises a small plug which can be made of numerous materials. The plug body is generally a rectangular solid except with respect to two of the plug's surfaces. One surface, the mounting surface, has a cylindrical concavity, designed to fit around the rear mount of the trigger guard. The second surface, the exterior or bottom surface, which would then face outward from the rifle, is slightly convex, with the convexity parallel to the line of the rifle when the digit support is installed. The general dimensions are roughly equal to the gap left between the trigger guard and pistol grip and the digit support is sized to allow the invention to interface with the trigger guard while at the same time allowing it to abut the rifle's pistol grip. The exterior surface has a longer length than the other surfaces so as to overlap with the receiver's trigger guard.

The invention has numerous advantages over the prior art. The first advantage is that the digit support is easier to install. The user simply inserts the digit support into the gap and leaves it there indefinitely. The digit support also allows the user to open the rifle's trigger guard, which may be necessary in the event the user opts to use gloved hands. The duckbilled grip must replace the rifle's existing grip and does not allow the trigger guard to open. The digit support is also relatively inexpensive and semi-disposable.

The more important features of the invention have thus been outlined in order that the more detailed description that follows may be better understood and in order that the present contribution to the art may better be appreciated. Additional features of the invention will be described hereinafter and will form the subject matter of the claims that follow.

The primary object of the present invention is to provide a digit support that will protect the fingers of the user of an AR-type rifle from injury and discomfort associated with the trough machined in the underside of an AR-type receiver.

It is another object of the invention to provide a digit support that, when installed, will enable a user to still open the trigger guard of an AR-type rifle.

It is still another object of the invention to provide a digit support that it easy to install and remove.

It is another object of the invention to provide a digit support, the manufacture of which is simple and economical so as to keep the final cost to the consuming public low.

Other objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
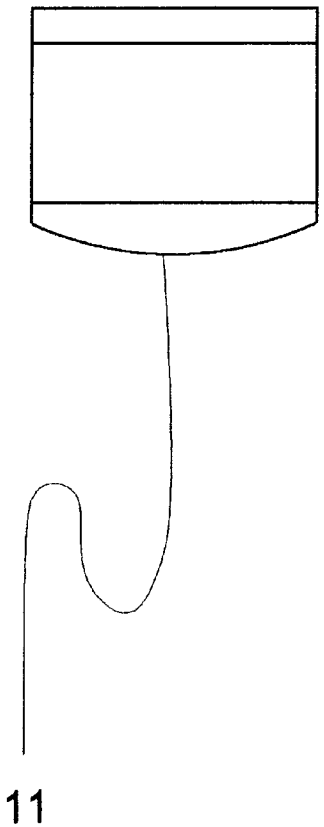
FIG. 1 is a front plan view of the digit support.
Figure 2:
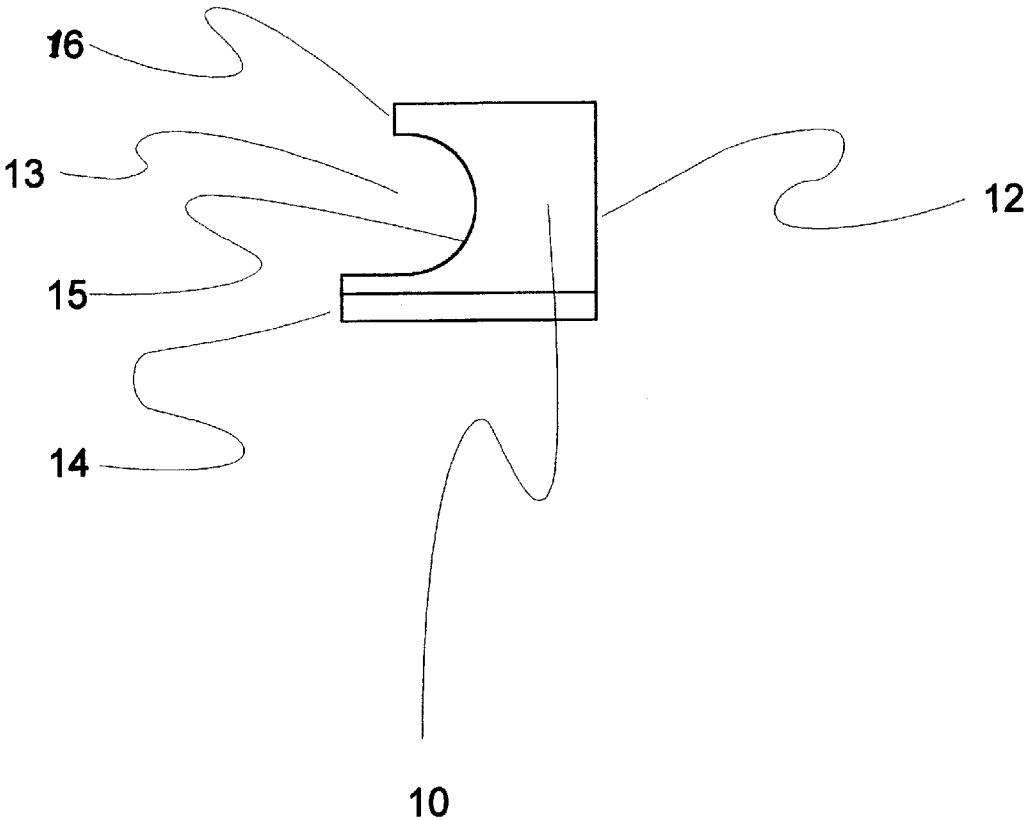
FIG. 2 is a left plan view of the digit support.

With reference now to the drawings, the preferred embodiment of the digit support embodying the principles and concepts of the present invention will be described. Specifically, referring to FIGS. 1 and 2, the digit support is essentially a generally rectangular plug, though other shapes may be utilized. The digit support may be molded or machined from various rigid or semi-rigid materials, such as rubber, plastic, epoxies, wood or metal. A rubber compound having a shore D hardness of 80 is preferred.

A semi-cylindrical concavity 15 is machined into or molded out of the front side 13 of body 10. The concavity 15 leaves two projections 16, 14 protruding front wards. The lower projection 14 is considerably longer than upper projection 16. The bottom projection 14 is slightly domed 11. The domed surface 11 has generally cylindrical orientation, extending axially along a line from the back 12 to the front 13 of the digit support body 10.

Figure 3:
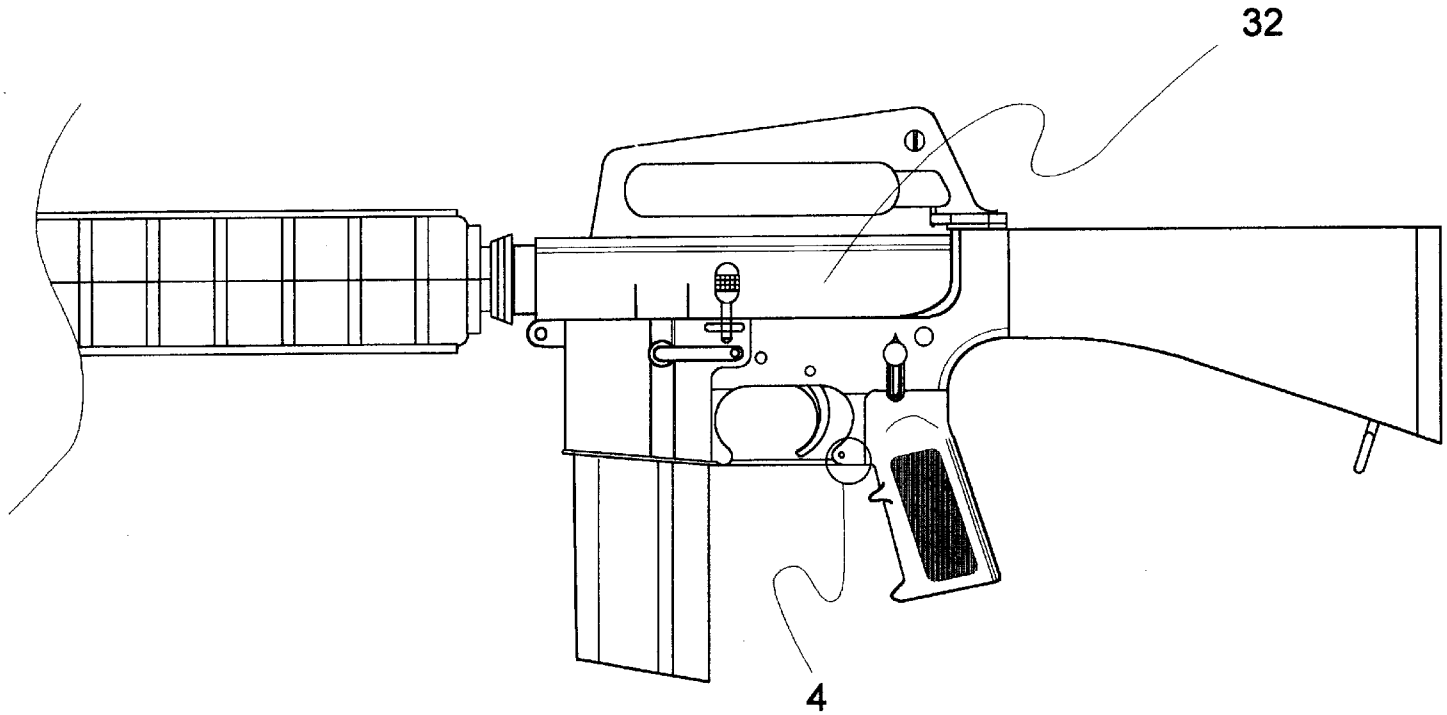
FIG. 3 is a left plan view of an AR-type rifle.
Figure 4:
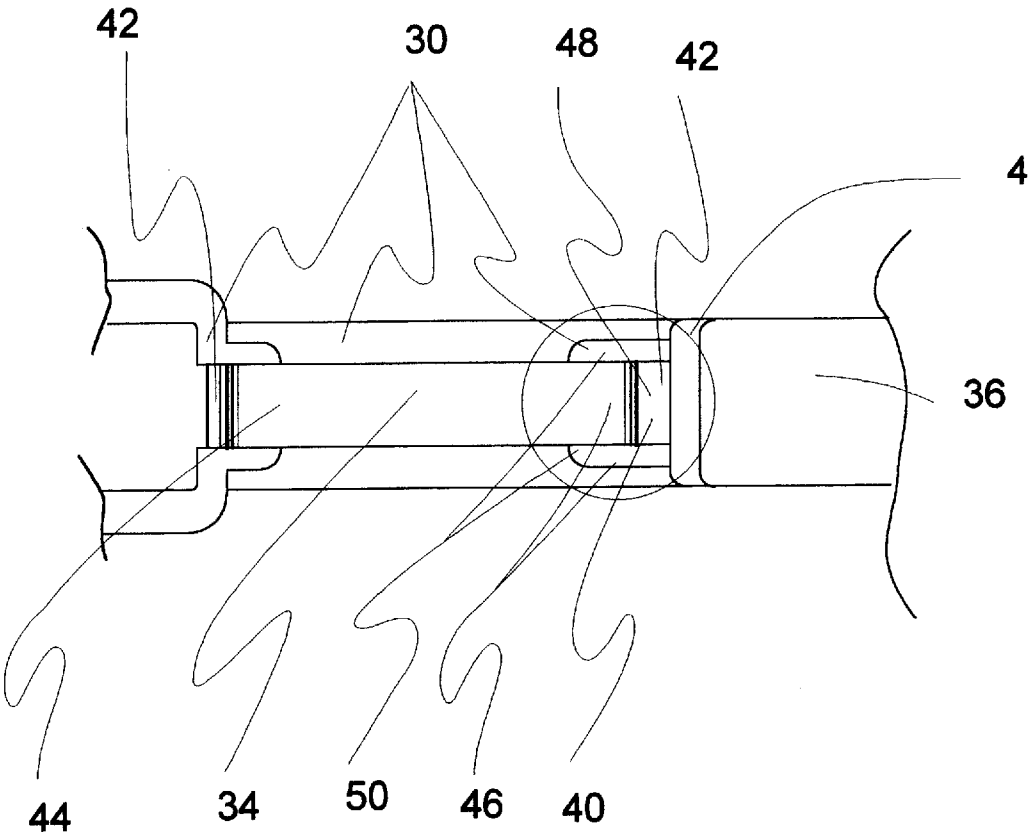
FIG. 4 is a close-up bottom plan view of an AR-type rifle receiver, focusing on circled area 4 in FIG. 3.
Figure 5:
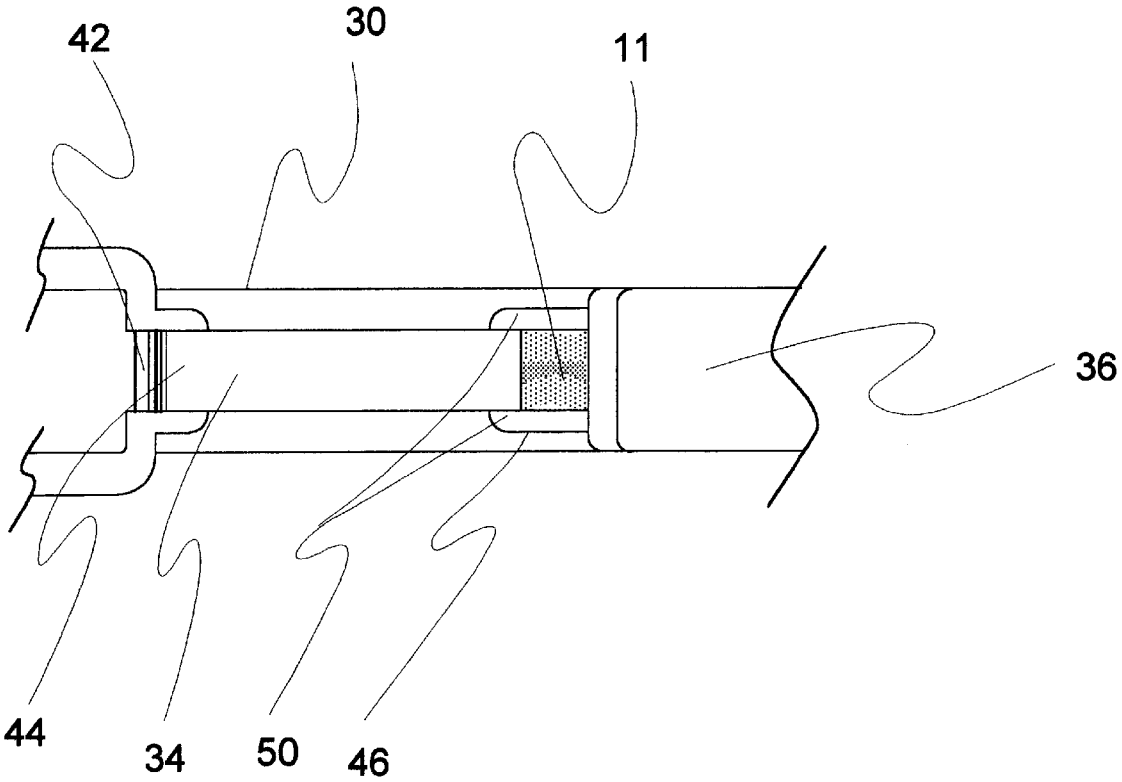
FIG. 5 is a close up view of the receiver of FIG. 4, with a digit support installed.
Figure 6:
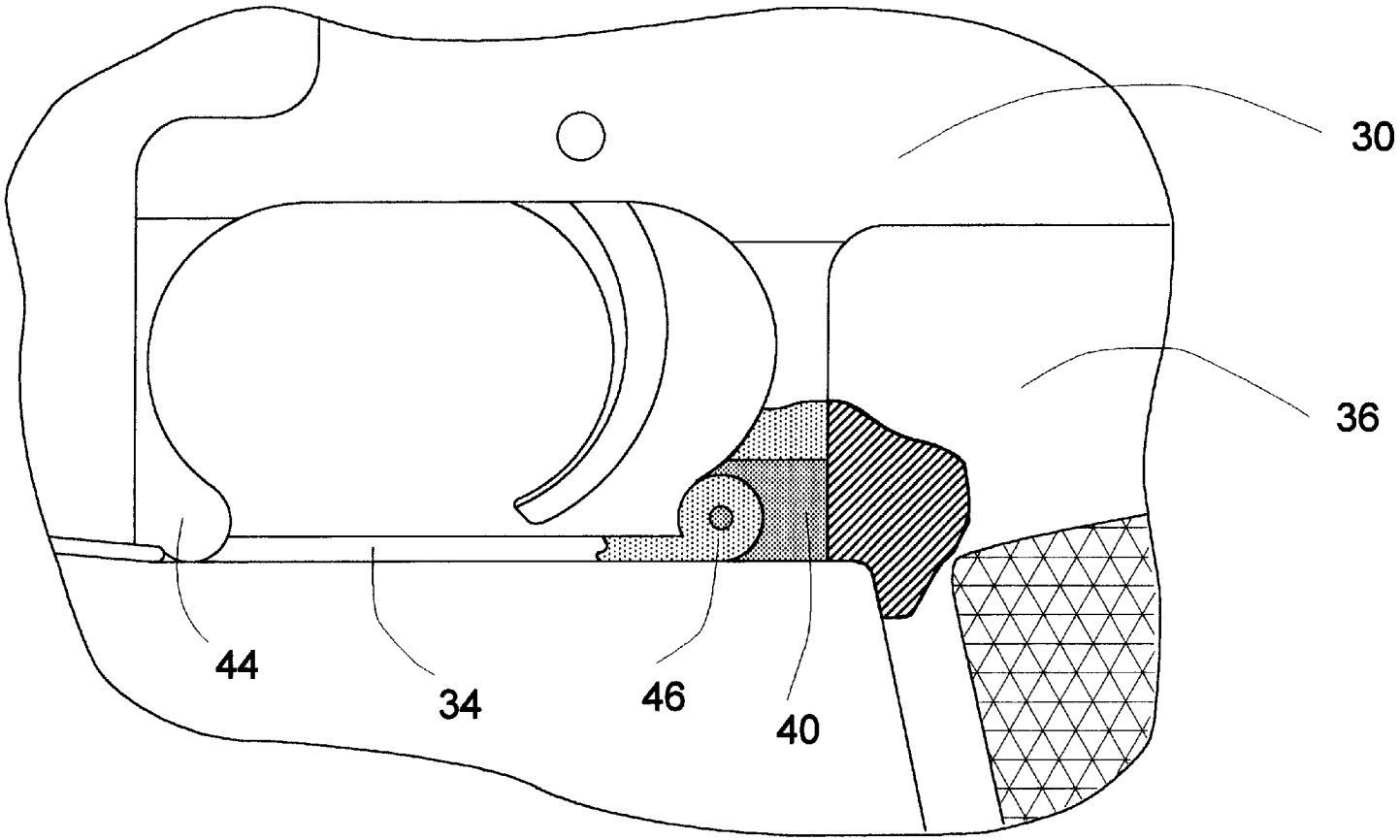
FIG. 6 is a cross-sectional view of the lower receiver of an AR-type rifle.
Figure 7:
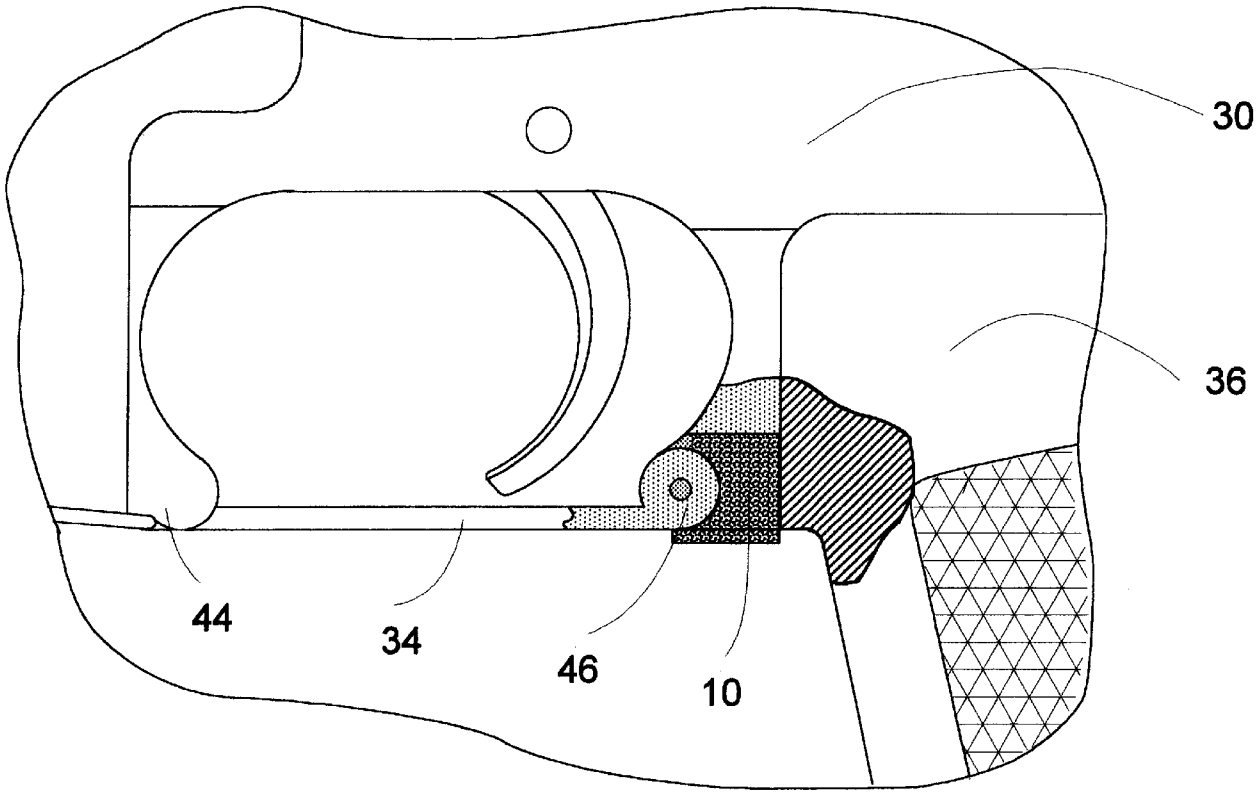
FIG. 7 is a cross-sectional view of the receiver of FIG. 6, with a digit support installed.

Before describing the appropriate use of the digit support, the construction of an AR-type receiver is necessary. Shown in FIG. 3, the receiver 30 is the bottom portion of the rifle 32. The area of particular interest is the area between trigger guard 34 and pistol grip 36. As shown in FIGS. 4 and 6 there is a gap 40 between trigger guard 34 and pistol grip 36. In order to receive the trigger guard 34, the receiver is machined with a trough 42. Trough 42 contains the front and rear mounting points 44, 46 for trigger guard 34 and extends towards pistol grip 36. Trough 42 is relatively shallow and encompasses most of the width of the lower receiver 30, leaving two walls 50 of approximately 0.125 inch on either side of the trough. The trigger guard can be released at the front mounting point 44 in order to pivot around the rear mounting point 46. When trigger guard 34 and pistol grip 36 are installed on the receiver 30, they do not make contact with each other. Instead, there is a gap 48 between them.

In its preferred embodiment, the digit support is molded to fit in the gap 48 between the trigger guard 34 and pistol grip 36. The fit should be snug, as it is preferred to allow friction and compression of the digit support to hold the digit support in place. Concavity 15 is sized to fit around the rear mounting point 46 of the trigger guard with the longer bottom projection 14 slightly overlapping trigger guard 34. The back 12 of the digit support abuts the pistol grip 36. Construction of the best mode, as described above, should allow for simple snap in installation.

There are a number of alternatives that may be utilized in the practice of this invention. First, the material may be any rigid or semi-rigid material. Second, the method of manufacture could involve molding, machining or any other method, depending on the material chosen. Thirdly, the general shape of the digit support body 10 or domed surface 11 may be altered, so long as the digit support fits within the gap 48 and domed surface 11 extends slightly above the trough walls 50. Fifthly, concavity 15 may be eliminated and adhesives may be used. Sixthly, the gap 48 may be packed with a material, such as an epoxy or silicone glue, and the gap 48 could serve as its own mold.

Although the present invention has been described with reference to preferred embodiments, numerous modifications and variations can be made and still the result will come within the scope of the invention. No limitation with respect to the specific embodiments disclosed herein is intended or should be inferred.

I claim:

1. For a rifle receiver having a pistol grip and a trigger guard, where the trigger guard, having forward and rear mounting points, is mounted in a specially designed receiving trough having two opposite walls and which extends parallel to the line of the receiver to the pistol grip, the trigger guard and pistol grip not having contact with each other thereby leaving a gap defined by four barriers, namely the opposite walls of the trough, the pistol grip and rear mounting point of the trigger guard, a digit support comprising:

a main body, having one exposed surface facing outward from the receiver when the body is installed and designed to fit inside the gap while abutting at least two opposite barriers defining the gap.

2. The digit support of claim 1, wherein the exposed surface extends beyond the level of the gap thereby supporting a user's digit away from the walls of the trough.

3. The digit support of claim 2, wherein the exposed surface has a slightly cylindrical curvature, said curvature having an axis parallel to the trough.

4. The digit support of claim 3, wherein the digit support is further secured with an adhesive.

5. The digit support of claim 4, wherein the material from which the digit support is made is selected from the group of materials consisting of: rubber, plastic, epoxy, silicon glue, wood, ferrous metal and nonferrous metal.

6. The digit support of claim 3, wherein a side of the main body abutting the trigger guard is concave in shape, said concavity having generally the same curvature as the trigger guard at its rear mounting point.

7. The digit support of claim 6, wherein the material from which the digit support is made is selected from the group of materials consisting of: rubber, plastic, epoxy, silicon glue, wood, ferrous metal and nonferrous metal.

8. The digit support of claim 2, wherein the digit support is further secured with an adhesive.

9. The digit support of claim 8, wherein the material from which the digit support is made is selected from the group of materials consisting of: rubber, plastic, epoxy, silicon glue, wood, ferrous metal and nonferrous metal.

10. The digit support of claim 2, wherein a side of the main body abutting the trigger guard is concave in shape, said concavity having generally the same curvature as the trigger guard at its rear mounting point.

11. The digit support of claim 10, wherein the material from which the digit support is made is selected from the group of materials consisting of: rubber, plastic, epoxy, silicon glue, wood, ferrous metal and nonferrous metal.

12. The digit support of claim 1, wherein the digit support is further secured with an adhesive.

13. The digit support of claim 12, wherein the material from which the digit support is made is selected from the group of materials consisting of: rubber, plastic, epoxy, silicon glue, wood, ferrous metal and nonferrous metal.

14. The digit support of claim 1, wherein a side of the main body abutting the trigger guard is concave in shape, said concavity having generally the same curvature as the trigger guard at its rear mounting point.

15. The digit support of claim 14, wherein the material from which the digit support is made is selected from the group of materials consisting of: rubber, plastic, epoxy, silicon glue, wood, ferrous metal and nonferrous metal.

* * * * *